US008905158B2

(12) United States Patent
Ritchie et al.

(10) Patent No.: US 8,905,158 B2
(45) Date of Patent: Dec. 9, 2014

(54) DOWNHOLE TOOL

(75) Inventors: Darren Ritchie, Aberdeenshire (GB); Krzysztof Machocki, Aberdeenshire (GB); Alan Mackenzie, Aberdeenshire (GB)

(73) Assignee: Paradigm Oilfield Services Limited, Aberdeenshire (GB)

( * ) Notice: Subject to any disclaimer, the term of this patent is extended or adjusted under 35 U.S.C. 154(b) by 616 days.

(21) Appl. No.: 13/201,117

(22) PCT Filed: Feb. 11, 2010

(86) PCT No.: PCT/GB2010/050219

§ 371 (c)(1),
(2), (4) Date: Oct. 11, 2011

(87) PCT Pub. No.: WO2010/092389

PCT Pub. Date: Aug. 19, 2010

(65) Prior Publication Data

US 2012/0037426 A1 Feb. 16, 2012

Related U.S. Application Data

(63) Continuation-in-part of application No. 12/378,882, filed on Feb. 19, 2009, now Pat. No. 8,028,763.

(30) Foreign Application Priority Data

Feb. 12, 2009 (GB) ..... 0902253.4

(51) Int. Cl.
*E21B 7/00* (2006.01)
*E21B 10/32* (2006.01)
*E21B 23/00* (2006.01)

(52) U.S. Cl.
CPC ..... *E21B 10/322* (2013.01); *E21B 23/006* (2013.01)
USPC ..... 175/57; 175/344

(58) Field of Classification Search
CPC ... E21B 23/06; E21B 10/322; E21B 10/3325; E21B 10/345; E21B 23/006
USPC ..... 175/263, 269, 273, 267, 298, 57, 344
See application file for complete search history.

(56) References Cited

U.S. PATENT DOCUMENTS 1,485,642 A * 3/1924 Stone ..... 175/268
3,126,065 A 3/1964 Chadderdon (Continued)

FOREIGN PATENT DOCUMENTS

DE 27 23 785 A1 11/1978

OTHER PUBLICATIONS

International Search Report and Written Opinion; dated Mar. 2011, 11 pages.

(Continued)

*Primary Examiner* — Jennifer H Gay
*Assistant Examiner* — George Gray
(74) *Attorney, Agent, or Firm* — Drinker Biddle & Reath LLP

(57) ABSTRACT

An underreamer tool for use in a wellbore of an oil or gas well and a method of actuation. In an embodiment, the underreamer tool has body having a longitudinal axis and a fluid conduit, a tool element and an actuation device configured to urge the tool element relative to the body from a first configuration into a second configuration. In this embodiment, a portion of the tool has a curved actuation surface and as the tool element is urged across the curved actuation surface, the tool element is moved radially with respect to the body of the tool. Typically, the actuation device may include a piston driven by pressure of fluid circulated through the fluid flow conduit.

19 Claims, 11 Drawing Sheets

(56) References Cited

U.S. PATENT DOCUMENTS

| | | | | |
|---|---|---|---|---|
| 7,370,712 | B2 | 5/2008 | Stout et al. | |
| 7,703,553 | B2 | 4/2010 | Eddison et al. | |
| 7,757,787 | B2 | 7/2010 | Mackay et al. | |
| 8,028,763 | B2 * | 10/2011 | Mackenzie | 175/57 |
| 2002/0070052 | A1 | 6/2002 | Armell et al. | |
| 2007/0089912 | A1 * | 4/2007 | Eddison et al. | 175/269 |
| 2007/0163808 | A1 | 7/2007 | Campbell et al. | |
| 2009/0095532 | A1 | 4/2009 | Laird et al. | |

OTHER PUBLICATIONS

Invitation to Pay Additional Fees, dated Mar. 2011, 5 pages.

* cited by examiner

DOWNHOLE TOOL

FIELD OF THE INVENTION

The present invention relates to downhole apparatus and, in particular, to downhole tools for engaging a wall of a wellbore. In one particular embodiment, the invention relates to an underreamer tool which can be selectively operated to increase the internal diameter of a wellbore. The wellbore is typically in an oil or gas well, but the invention is useful in other wellbores and boreholes generally.

BACKGROUND TO THE INVENTION

In wellbore operations, it is sometimes necessary or desirable to enlarge a diameter of a wellbore section for fitting different pieces of equipment in downhole locations. Traditionally, enlargement of a wellbore has been carried out by performing an underreaming operation (after a well has been drilled) using an underreamer tool provided with cutting devices typically provided on extendable and retractable arms. Such a tool is fitted to a string of tubulars or jointed pipe which is then rotated to turn the underreamer so that it cuts into a section of the inner wall of the wellbore. For example, an underreamer may be run in an 8 inch (0.2032 meters) open hole section of the wellbore to expand its diameter to around 10 inches (0.254 meters). The section of wellbore wall may be lined with a tubular or casing in which case the operation is referred to as a milling operation which can be conducted with similar tools to an underreamer with suitable modifications to the cutting elements, or may be an open hole (non-lined) section exposed to the geological formation.

More recently, underreamers have been incorporated in the same string as used for a drilling operation, i.e. a drill string, to mitigate costs which would otherwise be required to complete a separate reaming run into the wellbore. Such underreamers may be designed to be positioned closely behind the drill bit itself, providing a "near bit" underreamer as known in the art.

Typically, the cutting devices of the underreamers are actuated when required. In order to do so, a mechanical actuation device can be employed to force the cutting devices radially outwards. However, these can suffer from problematic frictional effects of the interaction of the actuation components, and as the cutting elements come into contact with the wellbore wall, the forces encountered may urge the cutting elements back toward their non-actuated positions.

Hydraulic actuation devices are also known in such tools, where for example the cutting elements are movable outward radially into the wellbore annulus by applying pressure inside the tool acting directly on axially arranged pistons that drive cams, racks or levers, against the pressure of fluid circulating in the wellbore annulus. Such tools work on the basis that the pressure required inside the tool typically needs to overcome the pressure of fluid in the wellbore annulus, which may vary so that it may be difficult to predict at what point the tool is opening because there is no definite threshold of pressure differential required to be applied inside the tool to move the cutting devices. Additionally, the piston areas are geometrically constrained due to the nature of the space available in the wellbore and the resultant radial forces which may be applied to the rock face may be insufficient for the purposes of rock removal.

SUMMARY OF THE INVENTION

According to a first aspect of the invention, there is provided a downhole tool comprising:

a body defining a longitudinal axis of the tool; and a tool element adapted to be urged by an actuator across a curved surface of the tool to move the tool element radially of the main body.

The actuator may constitute an actuation device.

According to a second aspect of the invention, there is provided an underreamer tool for use in a wellbore, the tool comprising: a body having a longitudinal axis, a tool element and an actuation device configured to urge the tool element relative to the body from a first configuration into a second configuration, wherein a portion of the tool has a curved actuation surface and wherein the tool element is urged across the curved actuation surface of the tool whereby movement of the tool element across the curved actuation surface moves the tool element radially with respect to the body of the tool.

Thus, by moving the tool element across the curved surface the tool element can be moved into engagement with a wall of a wellbore. The curved surface may allow the tool element to adopt different radial positions.

The curved surface may be in the form of an arc. The arc of the surface typically extends radially with respect to the longitudinal axis of the tool and preferably comprises a constant radius along its length. The arc may have an apex or apogee that may correspond to the radially outermost point of the surface, and/or the radially outermost position of the tool element. The arc circumference may be aligned along and/or parallel to the longitudinal axis of the tool, e.g. longitudinally with respect to the longitudinal axis The curved actuation surface may guide movement of the tool element. In particular, the curved actuation surface may include a curved, e.g. arcuate, track for the guiding the tool element, and the tool element may be mounted on the track, for example, the curved actuation surface may restrict movement of the tool element along the track, so that axial translation and radial movement of the tool element is permitted with respect to the longitudinal axis of the tool body (e.g. movement in the same radial plane of the track) but other movement, e.g. circumferential or lateral movement of the tool element with respect to the axis e.g. is restricted. The track may include side rails to restrict lateral movement of the tool element. The tool element may therefore be movable along the track, which may be along a longitudinal direction of the tool.

Preferably, the track is coupled to the body by a securing mechanism which more preferably can be selectively enabled and disabled from outside the tool, typically without the requirement to disassemble the actuation mechanism of the tool.

Preferably, the securing mechanism comprises a key provided on one of the track and the body and a slot provided on the other of the track and the body, and more preferably, the slot is larger than the key to thereby provide a gap into which a locking block can be inserted to selectively lock the securing mechanism. Typically, the locking block itself can be locked in place in the gap by a fixing means which may be a bolt or screw or the like. Preferably, the securing mechanism may further comprise a fixation member to further retain the track on the body where the fixation member may comprise a member such as a rod which preferably passes through the body and through the track.

The track may define first and second portions having different radii of curvature. Thus, the slope of the track may vary along its length, along the length of the tool. The track may include a first sloped portion for guiding the tool element into a first radial position and a second sloped portion for guiding the tool into a second radial position radially offset relative to the first radial position. The tool may be adapted to hold the tool element in the first and/or second position, as required. Thus, the tool element can have different radial positions corresponding to different stages of actuation of the tool, for example, to engage sections of wellbore wall having different diameters.

The tool may be provided with a plurality of tool elements, each mounted to a track for longitudinal translation of the elements along the track. The tool elements may be spaced apart circumferentially around the body of the tool. Different tracks may have different radii of curvature, so that translation of the tool elements along the tracks may result in different radial displacement of different tool elements.

The tool element may have a first surface for engaging a wellbore wall, and a second surface adapted to engage said curved surface of the tool. The first surface is typically an outer surface of the tool element, in use, and the second surface typically an inner surface of the tool, in use. The second, inner surface may be adapted to contact or juxtapose said curved surface of the tool so as to be guided by or follow the contours of the curved surface, e.g. upon axial translation of the tool.

The first and second surfaces of the tool element may define curved surfaces, for example arcuate surfaces. The radius of curvature of the first and second surfaces of the tool element may be different or may be the same.

The first and/or second surfaces of the tool element may both or each define a first curved surface portion and a second curved surface portion having different radii of curvature. The first and/or second surfaces may define a substantially planar surface portion.

The tool element may be adapted to lie against the curved actuation surface. The curved actuation surface may comprise a first contact surface and the tool element may define a second contact surface adapted to juxtapose, complement and/or fit against the first contact surface. Thus, the first and second contact surfaces may provide complementary curved surfaces, e.g. the first surface may be a convex surface and the second surface may be a concave surface of a corresponding curvature.

The tool element may have first and second ends of the tool element having different thicknesses. Thus, the tool element may taper toward an end of the tool element. Typically, the first end may be thinner than the second end, and the first end may be arranged to lead the second end during movement of the tool element across the curved surface and the track into a position for engagement with the wellbore. At least a portion of the tool element may be in the form of a wedge configured to wedge between the main body of the tool and the wall of the wellbore, in use when the tool element is in the second configuration. The first end of the tool element may be adapted to engage a wall of the wellbore at a shallow angle to facilitate higher outward deployment forces of the tool element with the wellbore wall, and to facilitate engagement of the tool element with the wellbore wall. When a first, outer surface and a second, inner surface of the tool element is curved, the tool element may form a curved wedge. The second end of the tool element may be configured to engage the wellbore wall after the first end has engaged the wellbore wall, during translation of the tool element across said curved surface from the first configuration to the second configuration.

Translational motion of the tool element along the track may result in a radial displacement of the tool element and/or wellbore engaging surfaces of the tool element. In second configuration, the second end of the tool element may be more radially displaced than the first end of the tool element with respect to the longitudinal axis of the tool.

Due to the curved trajectory of the tool element, the tool element can be presented gradually to the wellbore wall, at a shallow angle with respect to the wellbore wall. This provides an enhanced outward force applied to the cutting structure in deployment.

In another embodiment, where the slope of the track may vary along its length (e.g. along the longitudinal direction of the tool), the rate of radial displacement of the tool element may vary, for example, at different stages of actuation of the tool element.

In the first configuration, the tool element may be retracted and in the second configuration, the tool element is more radially extended with respect to the longitudinal axis of the tool. The tool element may be moved by the actuation device between an initial, retracted position to a final, fully extended position, e.g. following along the track. In the second configuration, an apex or apogee of the curved outer surface of the tool element may define an apex or apogee which, in the fully extended position, may locate above the apex or apogee of the curved surface of the tool and/or of the arc of the track.

Thus, the first end of the tool element may form a leading or toe portion and the second end of the tool element may form a trailing or heel portion.

The tool element may be mounted in a recess of the main body. The recess may include end stops for limiting motion (especially axial translation) of the tool element along the track. The track may be formed in a wall of the main body.

The tool element may include cutting elements. More specifically, the first, outer surface of the tool element may be provided with cutting elements for cutting into a wellbore wall. The outer surface may extend between first and second ends of the tool element (for example, leading and trailing ends), and may have a first group of elements toward the first end and a second, separate group of elements toward the second end, so that the first and second groups of cutting elements may engage with the wellbore at different positions along the track, e.g. at different stages of actuation. In this way, the second group of elements may be arranged to expand an initial hold in the wellbore wall formed by the first group of elements. The cutting elements can incorporate a hard material such as diamond material e.g. polycrystalline diamond material, or tungsten carbide material.

The tool may take the form of an underreamer.

As the tool element is gradually presented along the arc, the cutting elements, or a group of the cutting elements for example positioned near the apex or apogee of the outer surface of the tool elements, may be moved gradually into contact with the wellbore wall. In use, this facilitates the formation of an initial pocket, for example by a scraping or shearing effect of the cutting elements against the wall in longitudinal direction, and as further elements are brought into contact the pocket can be expanded by the trailing elements or group of elements. This mechanism in turn helps to reduce the force that would otherwise need to be applied to the cutting elements to achieve the cutting action. This gradual presentation of the tool element provides a "scything" action which is a more efficient cutting motion, and facilitates reducing vibrations such as tool face judder.

According to a third aspect of the invention there is provided a method of actuating an underreamer tool, the method comprising the steps of: urging a tool element across a curved surface of the tool, and moving the tool element radially with respect to a main body of the tool.

According to a fourth aspect of the invention there is provided a downhole tool comprising:

a tubular main body adapted to be coupled to a downhole tubular string, the tubular main body defining a fluid flow conduit for drill fluid to be pumped through the main body via the tubular string;

a tool element for engaging a wellbore wall;

a movable actuation device arranged to be exposed to a fluid pressure differential through the main body for urging the actuation device relative to the main body, and arranged to drive engagement of the tool element with the wellbore wall; and a control device configured to engage the movable actuation device for controlling movement of the actuation device relative to the main body.

The actuation device may be adapted to move longitudinally along the main body, and the control mechanism may be configured to determine or restrict the longitudinal movement of the actuation device along the main body.

The actuation device may comprise a hydraulic device. In particular, the actuation device may be a piston adapted to be driven by a fluid pressure differential in the tool. The actuation device may be located between an inner tubular member and the main body, and may be located in the conduit. Optionally the pressure differential can be generated by positioning a nozzle in a bit below the tool or in a flow tube below a port. More specifically, the actuation device may be in the form of an annular device, for example adapted to fit in an annular space defined between the inner tubular member and the main body. The actuation device may sealably engage with an inner surface of the main body and an outer surface of the inner tubular member, and may thus permit fluid to act against the actuation device to generate a pressure differential across the actuation device to drive movement of the actuation device. The inner tubular member may include a flow port for fluid pumped through the main body to access the actuation device. The flow port may be a continuously open flow port for continuous exposure of the actuation device to fluid in the fluid conduit.

The control device may be in the form of a control sleeve fitted around the actuation device, thus it may be fitted in the annular space between the tubular member and/or the actuation device and the main body. The actuation device may be movable relative to the sleeve. The sleeve may be movable relative to the main body, for example, longitudinally.

Typically, the control sleeve may be rotatable about the longitudinal axis of the tool. The control sleeve may provide an abutment for the actuation device to limit movement of the actuation device longitudinally. The control sleeve may take the form of an indexing sleeve.

The control sleeve may be provided with a longitudinal slot adapted to receive a part of the actuation device. The slot may have a surface defining the abutment. The control sleeve may have a second longitudinal slot adapted to receive a part of the actuation device. The first and second longitudinal slots may have a different length, so that the first and second longitudinal slots may therefore stop the actuation device in different longitudinal positions.

The control sleeve may have plurality of longitudinal slots disposed circumferentially around the control sleeve. The circumferentially disposed slots may include a first set of longitudinal slots and a second set of longitudinal slots. Each set of slots may comprise slots of the same configuration. Each of the slots of the first set may have a different length to each of the slots of the second set of slots.

The circumferentially disposed slots may alternate between slots of a first length and slots of a second length. The slots of the first length may form the first set and the slots of the second length may form the second set of slots. Thus, the sleeve may be rotatable around the longitudinal axis so that the actuation device can be alternately received in and/engage with a slot of a first length and a slot of a second length, at corresponding different rotational positions of the control sleeve. Typically, the second set of slots may permit sufficient movement of the actuation device along the slot for driving the tool element for engagement with the wellbore wall, whilst the first set of slots prevent movement of the actuation device such that the actuation device is unable to actuate the tool elements and/or drive the tool elements for engagement with the wellbore wall, even if pressure is applied to the actuation device by the fluid pumped into the wellbore.

The actuation device may be adapted to engage with the sleeve to move the sleeve into different rotational positions. The slots may include a guide to guide the actuation device longitudinally into engagement with a slot. In particular, the guide may take the form of a sloped guide surface of the slot for transferring longitudinal motion of the actuation device into rotational motion of the sleeve.

The tool may further include a holding device for retaining the control member and/or the actuation device in position within the main body of the tool. The holding device may take the form of a ring fitted around the actuation device, and may have internal longitudinal grooves adapted to receive outer longitudinal ribs of the actuation device to hold the actuation device in place rotationally whilst permitting longitudinal movement of the actuation device along the main body of the tool and relative to the holding device.

The holding device may provide a stop for the control device, and may be adapted to engage with the control device. When in the form of a control sleeve, the control device may be adapted to receive a part of the holding device in a longitudinal slot of the control sleeve. The holding device may guide the actuation device into engagement with the control sleeve. The holding device may be adapted to engage with the sleeve to move the sleeve into different rotational positions. The slots may include a guide to guide the holding device longitudinally into engagement with a slot.

More specifically, the actuation device and the holding device may be arranged to permit alternate engagement of the actuation device and holding device with a slot of the control sleeve. The control sleeve may engage with the holding device when fluid flow through the conduit is below a threshold value, or when there is no fluid pumped through it. The control sleeve may then be biased by a spring into engagement with the holding device, to permit the holding device to help rotate the sleeve. When there is flow through the conduit, for example so that it imparts sufficient force to the actuation device to overcome the spring bias, the actuation device may engage the control sleeve to move the control sleeve clear of the holding device to permit rotation of the control sleeve.

In this way, switching fluid flow between flow and no flow conditions through the conduit may initiate an actuation of the tool elements into engagement with the wellbore. More specifically, switching of flow conditions may rotate the control sleeve so that the actuation device piston can engage the control sleeve under full flow conditions in one set of slots where the tool elements remain retracted, for example when a drilling operation is being carried out using the same string and reaming is not required to be carried out, and in another set of slots where the tool elements are activated, when an underreaming operation is to be carried out.

Further features may be defined with reference to features described above in relation to any one of the first to third aspects of the invention where appropriate.

According to a fifth aspect of the invention, there is provided a method of actuating a downhole tool in a wellbore, the method comprising the steps of:

(a) coupling a downhole tool to a tubular string so as to provide for fluid flow through a main body of the tool;

(b) pumping fluid through the main body of the tool to move an actuation device to drive a tool element into engagement with a wall of the wellbore; and (c) engaging a control device of the tool to control movement of the actuation device.

Further steps may be defined with reference to features described above in relation to any one of the first to fourth aspects of the invention where appropriate.

According to a sixth aspect of the invention, there is provided an underreamer tool comprising:

a main body having a longitudinal axis and having a conduit for flow of fluid therethrough, at least one tool element movably mounted to the main body, a movable actuation device configured to urge the tool element radially with respect to the main body, the actuation device having a surface exposed to pressure exerted by the fluid circulated through the tool, and a biasing mechanism, wherein the tool element is urged by the actuation device from a first configuration to a second configuration by fluid pumped through the conduit applied to the actuation device at a pressure above a predetermined threshold, and is returned to the first position by the biasing mechanism at conduit fluid pressures below the threshold value.

Preferably, the fluid pumped through the conduit is drilling fluid.

Typically, the biasing mechanism is configured to exert a biasing force that acts to counteract conduit fluid pressure and to restrict engagement of the actuation device with the tool element. The biasing mechanism may include at least one biasing spring energised, tensioned or compressed, to provide the required biasing force. The biasing force exerted by the biasing mechanism may be selected to resist pressures below the threshold pressure required to move the tool element into engagement with the wellbore wall.

The biasing mechanism may include a control member or other control device configured to control actuation of the tool element. Typically, the control member may take the form of a control sleeve or an indexing sleeve movable to different positions, wherein in a first position the control member may permit engagement of the actuation device with the tool element and in a second position the control member may prevent or restrict engagement of the actuation device with the tool element. More specifically, the indexing sleeve may be rotatable about the longitudinal axis into different rotational positions.

The indexing sleeve may be selectively movable to the different positions by conduit fluid pressure applied to the actuation device above a predetermined threshold. More specifically, the indexing sleeve may be selectively movable to the different positions by switching the conduit fluid pressure applied to the actuation device between a pressure above a predetermined threshold and a pressure below the predetermined threshold.

The indexing sleeve may be repeatedly moved between the different positions, by pressure applied to the actuation device above the threshold, for example by repeat cycles of switching conduit fluid flow on or off, or above or below the threshold.

The indexing sleeve, in its second position, may present a physical obstruction to the actuation device for preventing the actuation device from moving into engagement with tool element. The indexing sleeve, in its first position, may present a passage for the actuation device to move into engagement with the tool element.

The indexing sleeve may have a plurality of longitudinal slots disposed circumferentially around the sleeve, with alternate slots differing in length such that a first slot may permit sufficient axial movement of the actuation device along the slot for driving the tool into a fully extended position and a second slot may prevent movement of the actuation device, wherein the first slot is aligned with the actuation device in the first position of the indexing sleeve, and the second slot is aligned with the actuation device in the second position of the indexing sleeve.

The actuation device may be movable longitudinally along the main body to engage with the indexing sleeve and may thereby rotate the indexing sleeve into different rotational positions.

The biasing mechanism may incorporate a biasing spring tending to urge the control member toward abutment with the actuation device. The biasing spring may be energised to impart a force to the control member, the spring energy may be set to provide a desired threshold to be overcome by the actuation device for moving the tool element.

Typically, the actuation device is mounted for movement longitudinally along the main body between a first longitudinal position of the actuation device in which the actuation device is permitted to urge the tool element into its second configuration, and a second longitudinal position of the actuation device in which the actuation device is prevented from urging the tool element into the second configuration.

Typically, the actuation device may be configured to urge the tool element indirectly via an intermediary member.

The tool element may be movable by the actuation device between a first position in which the tool element is fully extended for engagement with a wellbore wall, and a second position, in which the tool element is retracted, in the first position of the indexing sleeve. The tool may have a flow port for flow of fluid between the conduit of the main body and a drive face of the actuation device.

Typically, the tool may have cutting elements provided to an outer surface of the tool elements. The actuation device may comprise a hydraulic piston.

Further features may be defined with reference to features described above in relation to any one or more of the first to fifth aspects of the invention where appropriate. In particular, the actuation device may comprise an actuator and form part of an actuation mechanism.

According to a seventh aspect of the invention, there is provided a method of actuating an underreamer tool, the tool having a body with a longitudinal axis and a fluid conduit therethrough, a tool element coupled to the body and configured to be moved radially with respect to the longitudinal axis, a biasing mechanism, and an actuation device exposed to pressure of fluid in the fluid conduit and configured to urge the tool element from a first configuration to a second configuration, the method comprising the steps of:

(a) passing tubular fluid through the fluid conduit;

(b) moving the tool element from the first configuration to the second configuration by applying pressure tubular fluid at a pressure above a predetermined threshold pressure to the actuation device (c) applying tubular fluid at a pressure below the predetermined threshold and using the biasing mechanism to return the tool element from the second to the first configuration.

Typically, the tubular fluid is drilling fluid.

Further steps may be defined with reference to features described above in relation to any one or more of the first to fifth aspects of the invention where appropriate. In particular, the actuation device may comprise an actuator.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

BRIEF DESCRIPTION OF THE DRAWINGS

There will now be described, by way of example only, embodiments of the invention with reference to the accompanying drawings, in which.

DETAILED DESCRIPTION OF THE DRAWINGS

Figures 1, 2:
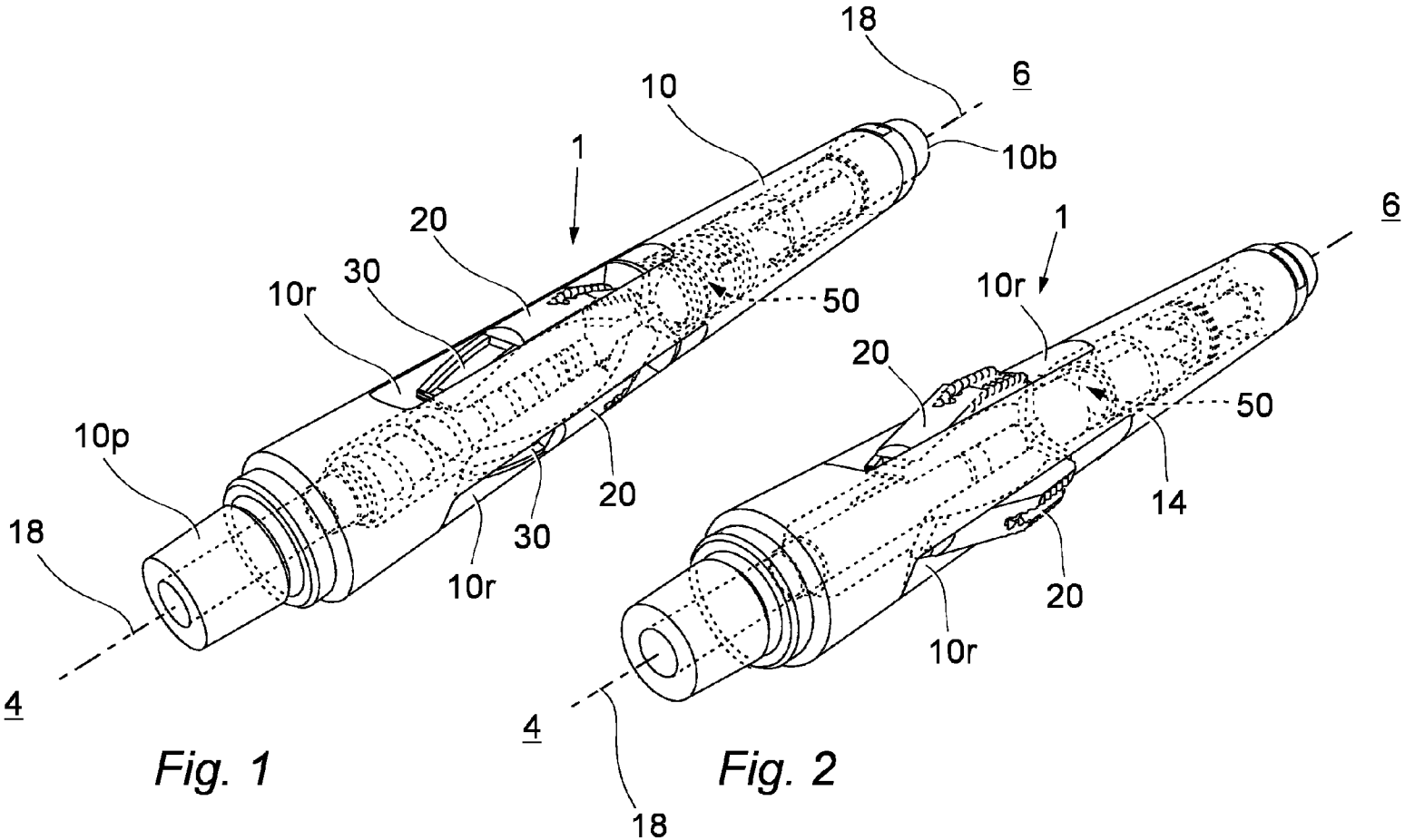
FIG. 1 is a perspective view of a downhole tool according to an embodiment of the invention showing external and internal components in a run-in configuration.
FIG. 2 is a perspective view of the downhole tool of FIG. 1 showing external and internal components in an activated configuration.

In the description that follows, like parts are marked throughout the specification and drawings with the same reference numerals, respectively. The drawings are not necessarily to scale. Certain features of the invention may be shown exaggerated in scale or in somewhat schematic form, and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. The wellbore may be 'open hole' or 'cased', being lined with a tubular string. Reference to up or down will be made for purposes of description with the terms "above", "up", "upward", "upper", or "upstream" meaning away from the bottom of the wellbore along the longitudinal axis of a work string and "below", "down", "downward", "lower", or "downstream" meaning toward the bottom of the wellbore along the longitudinal axis of the work string. Similarly 'work string' refers to any tubular arrangement for conveying fluids and/or tools from a surface into a wellbore. In the present invention, tubular string or drill string is the preferred work string.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about".

With reference firstly to FIGS. 1 and 2, a downhole underreamer tool 1 is provided with tool elements in the form of cutter blocks 20 shown respectively in retracted and extended positions. The underreamer 1 has a tubular main body 10 provided with a pin section 10*p* for connecting the tool 1 to an uphole section of a drill string (not shown) and a box section 10*b* for connection of the tool 1 to a downhole component, typically a drill bit (not shown) or other item of Bottom Hole Assembly (BHA). In this way, the underreamer 1 may be incorporated in a drill string behind or relatively close to a drill bit. The tubular main body 10 has a central bore 16 defining a longitudinal axis 18 and providing a fluid conduit 16 which is fluidly connectable with adjacent components of the drill string so that drill fluid can be circulated through the string, through the underreamer 1 and onward into the well typically via fluid outlet nozzles in the drill bit.

The underreamer 1 has an actuation device in the form of actuation mechanism 50, which may be operated to move the cutter blocks 20 between the retracted and extended positions. Operation of the actuation mechanism 50 is controlled by the flow of fluid pumped through the tool 1. The actuation mechanism 50 can be operated when required to move the cutter blocks 20 into the extended position for conducting a reaming operation, for example:— i) after a drilling cycle using the drill bit has taken place; or ii) in certain circumstances, whilst the drilling cycle is taking place such that the hole is drilled and reamed at the same time; or iii) in certain circumstances, after a drilling cycle using the drill bit has taken place and whilst the drillstring is being pulled back out of the hole, a back reaming operation is conducted to ease the pulling back out of the hole.

Further, the cutter blocks 20 are situated in a recess 10*r* in the main body 10 and are mounted for movement on a curved track 30 formed in the recess 10*r*. The track 30 guides the cutter blocks 20 in an arc that if extended would intersect the longitudinal axis of the main body 10, in a direction parallel to the longitudinal axis 18. Accordingly, the track 30 preferably comprises an arc having a constant radius along its length and having its two opposite ends arranged closest to the longitudinal axis 18 of the tool 1 and its apogee (with respect to the longitudinal axis 18 of the tool 1) arranged around the midpoint of the arc.

In other variations, the underreamer 1 may be incorporated in other kinds of tubular string, for example a casing string, and may be used with other tubular shoes instead of drill bits.

Figure 3:
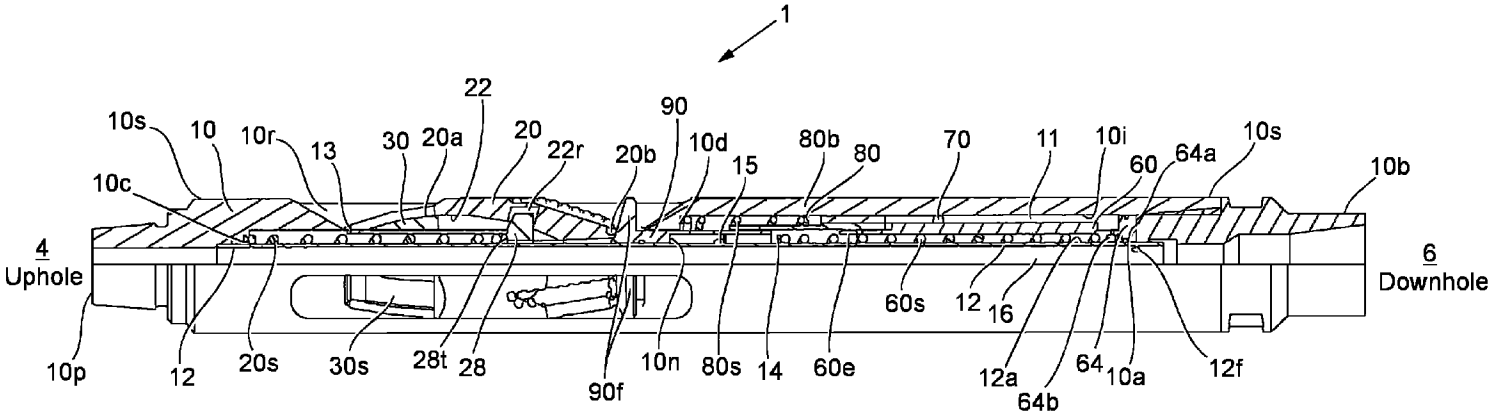
FIG. 3 is a cross-sectional view of the downhole tool of FIGS. 1 and 2 in the run-in configuration.
Figure 4:
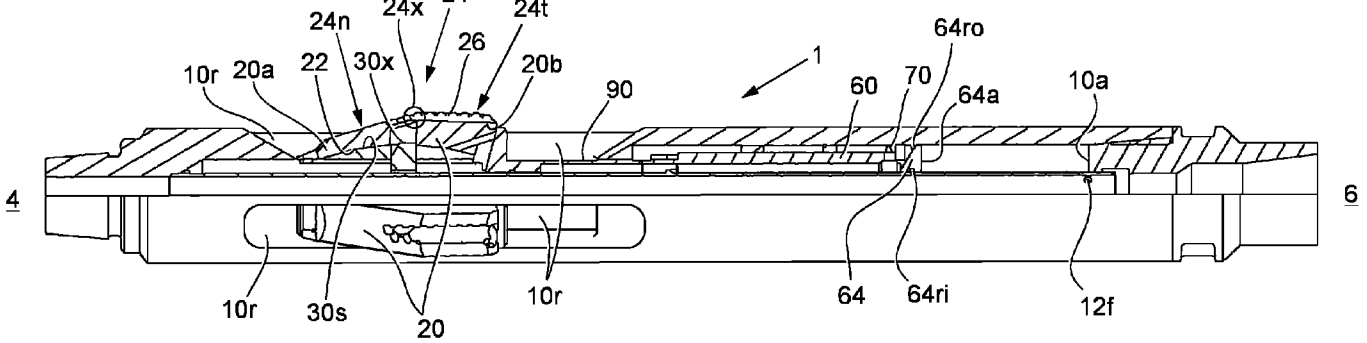
FIG. 4 is a cross-sectional view of the downhole tool of FIG. 2 in the activated configuration.

Turning now to FIGS. 3 and 4, the structure of the underreamer 1 can be seen in further detail. Internally of the main body 10, an inner tubular member 12 extends longitudinally and is attached inside the main body 10 at each end near the pin and box sections 10*p*, 10*b*. The inner tubular member 12 defines an internal fluid conduit 16 for flow of drill fluid. Between an outer surface 12*a* of the inner tubular member 12 and an inner surface 10*i* of the main body, there is defined an annular space or chamber 11 which houses various components of the actuation mechanism 50.

The actuation mechanism 50 includes a piston 60 toward a bottom end 6 fitted around the inner tubular member 12 in the chamber 11. The piston 60 can slide longitudinally in the annular chamber 11 along the inner surface 10*i* of the main body and the outer surface 12*a* of the inner tubular member 12, against a piston biasing spring 60*s* which is held in the chamber 11 radially inwardly of the piston 60 between an abutment surface 64*b* of the piston and an abutment ring 14 attached to the inner tubular member 12. A guide ring 70 is mounted around the piston 60 providing a snug fit between the outer surface of the piston and the inner surface of the main body, and is fixed with respect to the main body 10 by means of a locking device (not shown). The piston 60 is longitudinally slidable within the guide ring 70.

Within a middle portion of the tool 1, there is also mounted an actuation control sleeve 80 in the annular chamber 11, around the outside of the piston 60. The actuation control sleeve 80 is also longitudinally slidable with respect to both the guide ring 70 and the piston 60 against a control ring biasing spring 80*s* fitted between a main body abutment surface 10*d* and an abutment surface 80*b* of the flange or yolk 28. The spring 80*s* tends to bias the control sleeve 80 toward the guide ring 70 and/or the piston 60 as seen in FIG. 3. In addition, the control sleeve 80 is allowed to rotate about the longitudinal axis to facilitate actuation of the tool as discussed further below.

The control sleeve 80 also locates around an actuation sleeve 90 of the actuation mechanism 50 near the top end of the annular chamber 11. The actuation sleeve 90 is formed to fit around and sit against the inner tubular member 12, and is slidable along the tubular member 12 and the main body 10. A rear end 90*e* of the sleeve 90 is configured to engage and abut the end 60*e* of the piston so that the piston 60 can drive movement of the actuation sleeve 90 longitudinally. At an opposite end, the actuation sleeve 90 passes with close tolerance through a neck 10*n* of the main body and a front end flange 90*f* of the actuation sleeve 90 extends outwardly into the region of the recess 10*r* abutting an end 20*b* of the cutter blocks 20. The close tolerance fit of the sleeve 90 through the neck 10*n* typically provides an outlet for displaced fluid to escape into the wellbore annulus surrounding the tool 1 to prevent hydraulic lock. The close tolerance fit also typically prevents cuttings from entering the chamber 11 during operation.

As mentioned above, the cutter blocks 20 are slidable along the curved track 30 and are fitted in the recess 10*r*. They are biased toward the actuation sleeve 90 by a cutter block biasing spring 20*s* acting between a second abutment surface 10*c* and cutter block engagement flange 28 top surface 28*t*. As seen in FIG. 3, the cutter engagement flange 28 is movably mounted around the inner tubular member 12 radially inwardly of the cutter blocks 20, and extends radially outwardly to engage with an inner recess 22*r* of each of the cutter blocks 20. The flange 28 provides an interference fit with the inner recess 22*r* of each of the cutter blocks 20 so that the flange 28 moves longitudinally (against the bias of spring 20*s*) along the inner tubular member 12 when the cutter blocks 20 are moved along the track 30 and vice versa. The flange 28 extends sufficiently to permit the cutter blocks 20 to displace radially whilst maintaining inter-engagement with the cutter block recess 22*r* when the cutter blocks 20 are moved in an arc along the track 30.

In FIG. 3, the tool 1 is shown in a non-actuated configuration where cutter blocks 20 are in a retracted position, and the longitudinal position of the cutter blocks 20, the actuation sleeve 90, the control sleeve 80 and the piston 60 is maintained by the various biasing springs. The cutter blocks 20 are pushed against the actuation sleeve 90 by spring 20*s* action on flange 28 in engagement with the cutter blocks 20. In turn therefore, the action of the spring 20*s* also causes the actuation sleeve 90 to be pushed rearward into the annular chamber 11, against the front side of the abutment ring 14 and the flange 90*f* against the front edge of the main body neck 10*n*. Movement of actuation sleeve 90 toward end 6 is constrained by formations such as lugs provided on the actuation sleeve 90 arranged to contact a shoulder 15 formed in the inside of the chamber 11. The piston 60 is urged by spring 60*s* so that piston head 64 naturally rests against the end surface 10*a* of the main body. The control sleeve 80 is pushed against the piston end 60*e* and the guide ring 70, acting as an end stop for the control sleeve 80.

The cutter blocks 20 can be moved from a non-activated retracted position in FIG. 3 to an activated extended position in FIG. 4 by applying pressure to a drive surface 64*a* of the piston head 64. Typically, this is done by pumping fluid through the drill string and central conduit 16 of the inner tubular member 12. As fluid is pumped down the drill string, the fluid, as it is jetted out of the drill bit nozzles into the wellbore, experiences a drop in pressure (due to the drill bit acting as a flow restriction that causes a change in fluid particle velocity) thus causing a differential pressure to exist between the inside of the tool and the outside. The fluid inside the string which is pumped through the conduit 16 accesses a micro-space between the drive surface 64*a* and the end surface 10*a* of the main body through a small radial flow port 12*f* provided through the inner tubular member 12, exposing the piston head 64 drive surface to significant pressure to force movement of the piston 60 along the annular chamber 11. Inner 64*ri* and outer 64*ro* o-rings fitted to the piston head 64 respectively seal against the inner surface of the main body 10 and the outer surface of the inner tubular member 12 to isolate fluid volumes. The pressure differential created in this way between the inside of the tubular string and the outside or annulus enables a positive pressure differential to be produced across the piston head 64 for driving the piston 60.

The piston 60 is thereby moved longitudinally along the annular chamber 11. The actuation mechanism 50 is arranged so that the piston end 60*e* can (but only when ribs 62 of the piston 60 move into the extended or long stroke slot 84*x* as will be described subsequently) engage the actuation sleeve 90 and thus in turn move the actuation sleeve 90 toward the upper end 4, when fluid pressure is applied. The actuation sleeve 90 then pushes the cutter blocks 20 gradually along the track 30 in an arc and into the extended position as shown in FIG. 4.

Typically, the tool 1 is run-in to a wellbore in the deactivated configuration shown in FIG. 3, and then it is activated at a desired location downhole. The cutter blocks 20 are moved to the extended position so that they can engage a wall of the wellbore to cut into the wall and extend the original diameter of the hole, being of a smaller gauge than required, i.e. under gauge. In the fully extended position, the cutter blocks 20 are designed to cut a hole to the required gauge.

In the present example, each cutter block 20 is formed as curved wedge where the rear end 20*b* of the block tapers in thickness toward its other leading end 20*a*, and has arcuate inner and outer surfaces 22, 24. In this example, the overall radius of curvature of the outer surface 24 is greater than the radius of curvature of the inner surface 22 and the curvature of the outer surface 30*s* of the track 30. The inner surface 22 of the cutter block 20 is formed to interlock with the track 30 to keep it in place on the track 30. The cutter block 20 engages with side rails of the track 30 which keep the cutter block 20 in place laterally, but permits translation of the cutter block 20 along the length of the track 30 and the longitudinal direction of the tool 1. Thus, the inner surface 22 of the cutter block 20 is designed to match and follow the curvature of an outer surface of the track 30. The outer surface 30*s* of the track 30 is convex outwards, the juxtaposing inner surface 22 of the cutter block 20 conversely being concave and directed radially inwardly with respect to the tool 1.

FIGS. 9-15 show that the curved or arced engagement surface 30*e* of the track 30 (that engages with a similarly and reciprocally formed curved or arced engagement surface on the underside of the cutter block 20) thereby provides a retention mechanism and is preferably in the form of a dovetail and comprises two main surfaces:—

- a lower surface 30*el* that in use will mainly bear the radially inwardly directed (i.e. compressive) forces from the cutter block 20; and
- an upper surface 30*eu* which projects upwardly from but at an angle less than 90 degrees with respect to the lower surface 30*el* and is therefore directed back towards the other side of the track 30 such that the upper surface 30*eu* retains the cutter block 20 in the track 30 and therefore bears any radially outwardly directed (i.e. tensile) force that acts between the cutter 20 and the track 30.

However, it should be noted that any other suitably shaped form of engagement between the cutter block 20 and the track 30 could be used by the skilled person in the art instead of the dove tail shape as illustrated such as a T-shaped slot, a half T-shaped slot or indeed any other suitable retention mechanism that will be apparent to the skilled person such as a number of captive ball bearings that are arranged to run in one of more slots or indeed any other suitable retention mechanism that will provide a secure coupling between the track 30 and the cutter block 20 and also permit axial movement between the two and also restrict lateral and relative radial movement of the cuter block 20 with respect to the track 30.

The track 30 is limited in extent to the front portion of the recess 10*r*, but sufficiently that it provides support for the cutter block 20 in both the fully retracted and fully extended positions. The track 30 is provided with an end stop 13 (seen in greater clarity in FIGS. 9 and 10) to abut the leading end 20*a* of the cutter block 20 in the fully extended position. If required or desired, the effective position of the end stop 13 can be varied, for instance by inserting an additional end stop (not shown) into the track 30 or by lengthening the end stop 13 itself. The end stop 13 is preferably arranged at an angle to the perpendicular (with respect to the longitudinal axis of the tool 1) such that it is arranged to be perpendicular to the direction of travel of the approaching cutter block 20, and furthermore is arranged to present a flat plane or buffer that is arranged to be parallel to the flat plane of the nearest approaching end of the cutter block 20 that will abut against it when the cutter block 20 is in the fully extended position. The cutter block 20 is additionally supported by the engagement flange 28 and the front flange 90*f* of the actuation sleeve 90.

An outer surface 24 of the cutter block 20 defines a nose region 24*n* and a tail region 24*t* separated by a shallow intersecting angle at intersection point 24*x*. The tail region 24*t* is provided with poly-crystalline diamond composite (PDC) cutting elements 26, which can impart an aggressive cutting action against the wellbore wall. The PDC elements 26 are provided in the thicker part of the wedge of the cutter block 20 and are progressively movable with the block 20 so that they extend outward of the main body 10 for the cutting of the borehole on actuation.

The nose region 24*n* also provides a smooth surface portion which transitions to include PDC elements 26 near the intersection point 24*x*. In the initial retracted position of FIG. 3, the nose portion 24*n* lies in the recess parallel to a longitudinal axis 18 of the tool 1 and does not extend beyond the outer surface 10*s* of the main body 10 of the tool 1.

When being actuated in the wellbore, the block 20 is moved from the position of FIG. 3 to FIG. 4, such that it travels along the track 30 and thicker parts of the wedged cutter block 20 are led progressively outwardly of the main body 10.

In the initial stages of travel along the track 30, the nose portion 24*n* is positioned outermost toward the wellbore wall (not shown), and this part of the block 20 is brought into contact with the wall first as it travels around the arc. By virtue of the arc, the angle of the path of the block 20 reduces toward an arc apex or apogee 30*x* and, the cutter elements 26 near the intersection point 24*x* begin to engage the wall with a component of motion longitudinally along the wall and to scrape out a pocket in the wellbore wall. Due to the arcuate motion and the curved wedge shape of the cutter block 20, the nose portion end 24*n* is moved away leaving only a limited area of the cutter block 20 to be brought into engagement with the wall at any particular time. This helps to enhance cutting pressure exerted by the cutter block 20 against the wall, and reduces friction so that it is easier to form the initial pocket for establishing an underreaming operation. Furthermore, when fully deployed, there are a relatively large number of cutting elements 26 all provided at the same radius, parallel to the longitudinal axis of the tool 1 which provides the advantage that if one cutter element 26 fails, others 26 will continue the ability to ream the borehole.

The outer surface 24 of the cutter block 20 is provided with groups of PDC elements 26. The nose portion 24*n* is provided with a first group and the tail portion 24*t* is provided with a second such group, which may be different from the cutter elements 26 in the first group. As the cutter block 20 is translated along the track 30, the PDC elements 26 in the nose portion 24*n* will engage and cut into the wellbore wall first to form an initial pocket or cut-out in the wellbore wall. As the cutter block 20 is translated further, the tail end 24*t* of the block 20 is gradually presented to the wellbore wall and the group of PDC elements 26 toward the tail end 24*t* are brought into engagement with the wellbore wall to expand the cut-out to full gauge. Thus, as the pocket has begun to be formed, by the leading group of cutting elements 26 toward the nose portion 24*n* of the cutter block 20, as the cutter block 20 is moved further around the arc, the cutters 26 on the tail portion 24*t* can engage progressively to continue to expand the pocket to full gauge when the block 20 has reached the fully actuated position as shown in FIG. 4.

In this position of FIG. 4, the tool 1 is ready to conduct the underreaming process. The lead PDC elements 26 which bite initially into the wellbore wall during the process are located around the intersection point 24*x*. The intersection point 24*x* is aligned over the apex or apogee 30*x* (i.e. the intersection point 24*x* is co-axial with the apex or apogee 30*x* with respect to the longitudinal axis of the tool 1) of the track arc which is a geometrically strong configuration for withstanding radial forces since such components arise normal to the arc and normal to the track 30 along which sliding motion can be accommodated as referred to above.

Due to the arcuate trajectory for the cutter blocks 20 provided by the track 30, the components of the forces normal to the arc acting along the longitudinal direction and therefore in resistance to the actuation mechanism 50 are small, and this facilitates keeping the cutter blocks 20 actuated and seated against the end stop 13. Similarly, it provides help to the biasing springs 20*s* to return the cutter blocks 20 after use. In addition, gentle contact of a wellbore wall against the inclined nose portion 24*n* helps the springs 20*s* to disengage the cutters 20 and initiate travel back along the arc track 30 and out of engagement and away from the wall.

FIGS. 9-15 show the details of a preferred securing mechanism to retain the track 30 and the cutter blocks 20 (although the cutter blocks 20 are not shown in FIGS. 9-15 to aid clarity of the rest of the components) on the tool 1 and specifically mounted on the main body 10 and which has the advantage that it can be easily and quickly assembled before and/or disassembled after a run in the hole without needing to open up the rest of the tool (particularly the actuation mechanism).

The track 30 is provided with a main key 102*m* provided laterally on each side and is further provided with an upper key portion 102L which in use will extend upwardly toward the upper end 4 of the tool 1. The main body 10 of the tool 1 is provided with a slot 100 that is formed in two parts, these being a main slot part 100*m*, which is arranged to have a significantly greater length than the main key 102*m* of the track 30, and an upper portion of the slot 1000 which is arranged to be of a similar size to the upper key portion 102U such that it will accommodate the upper key portion 102U in use.

The track 30 is installed in the main body 10 by placing the track 30 into the recess 10*r* such that the main key 102*m* and upper key portion 102U are slid (or moved radially inwardly) into the main slot 100*m* (the main slot 100*m* being of a length that is slightly greater than the combined length of the main key 102*m* and upper key portion 102U). The track 30 is now in the position shown in FIG. 10. It should be noted however that the dovetail key (not shown) of the cutter blade 20 has already been placed into the dovetail slot 30*e* prior to placing the track 30 into the recess 10*r* but the cutter blade 20 has been omitted from FIGS. 9-15 for clarity purposes.

Figure 11:
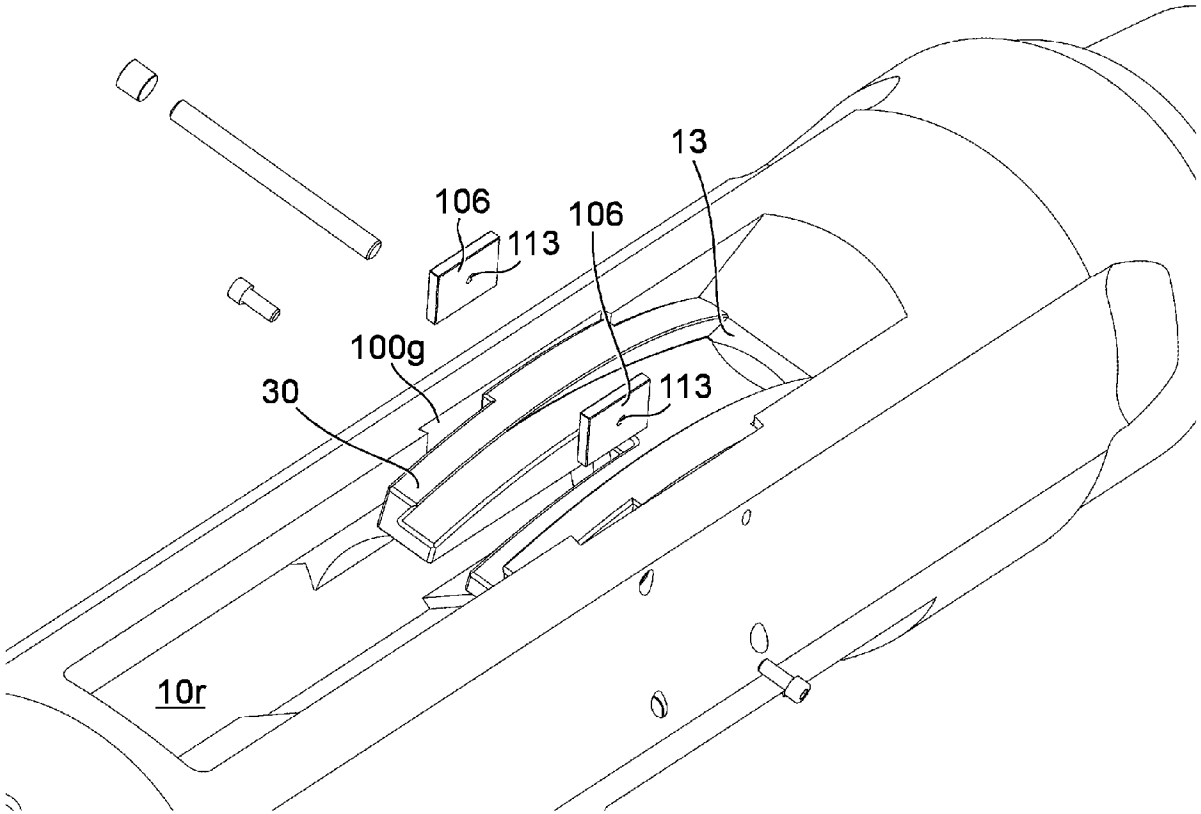
FIG. 11 is an exploded perspective view showing the next stage of installation of the track, where the track has been moved upwards into its in use position such that a lower key slides into a lower part of a slot formed in the tool body.

The installation of the track 30 (and cutter blade 30) is then continued by sliding it upwardly toward the upper end 4 as shown in FIG. 11, such that the upper key portion 102U is slid into the upper slot portion 100U and the upper end of the main key 102*m* butts against the upper end of the main slot portion 100*m*. As shown in FIG. 11, there is then a gap 100*g* in the slot 100 at the lower end thereof, behind (i.e. below) the lower end of the main key 102*m*.

Figure 12:
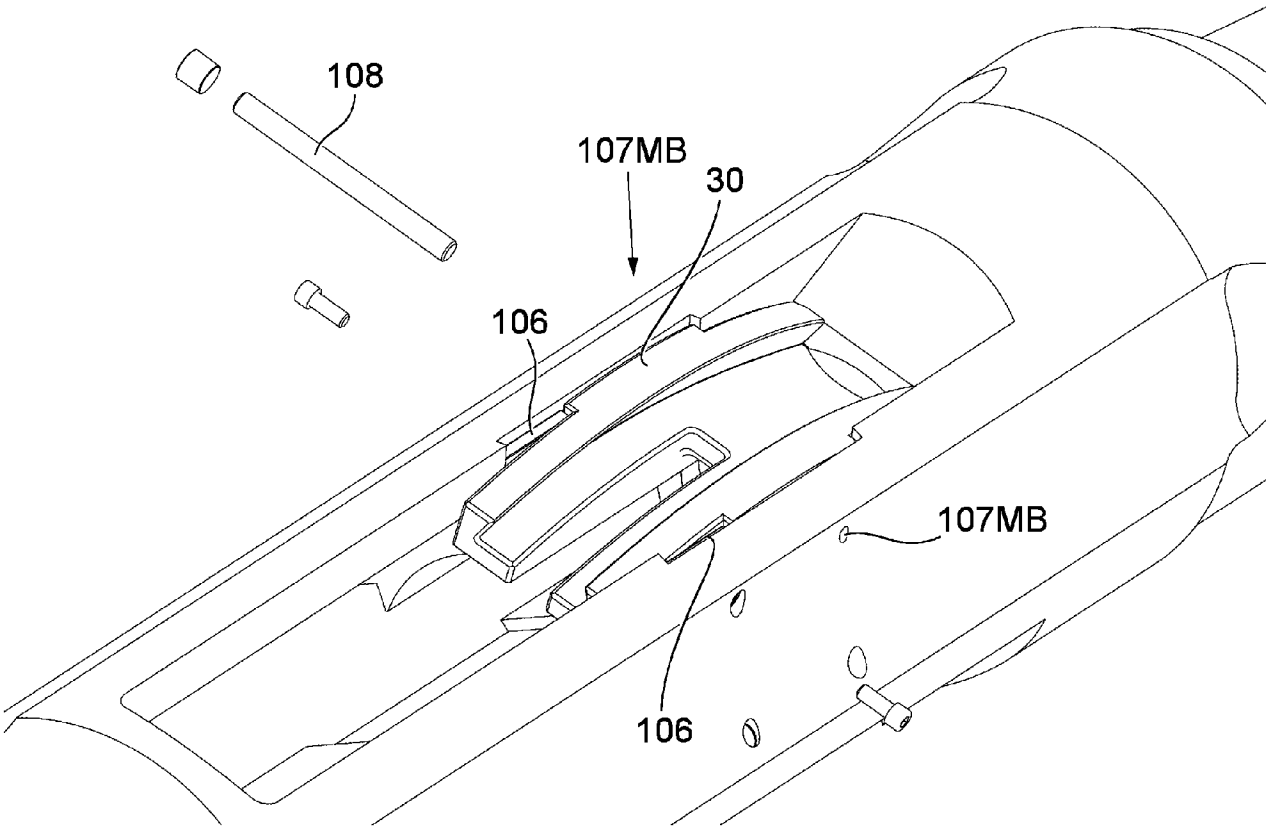
FIG. 12 is an exploded perspective view of the next stage of installation of the track on the body, where locking blocks have been inserted into place.

The next stage of the installation of the track 30 is shown in FIG. 12 where a locking block 106 is placed into the gap 100*g*, the locking block 106 being of a size such that it is a relatively close fit in the gap 100*g*. Thus, when the locking block 106 is so placed, unless the locking block 106 is removed from the gap 100*g*, the track 30 (and the attached cutter blade 20) is securely mounted on the main body 10 due to the upper key portion 102U being held captive in the upper slot portion 100U.

Figure 13:
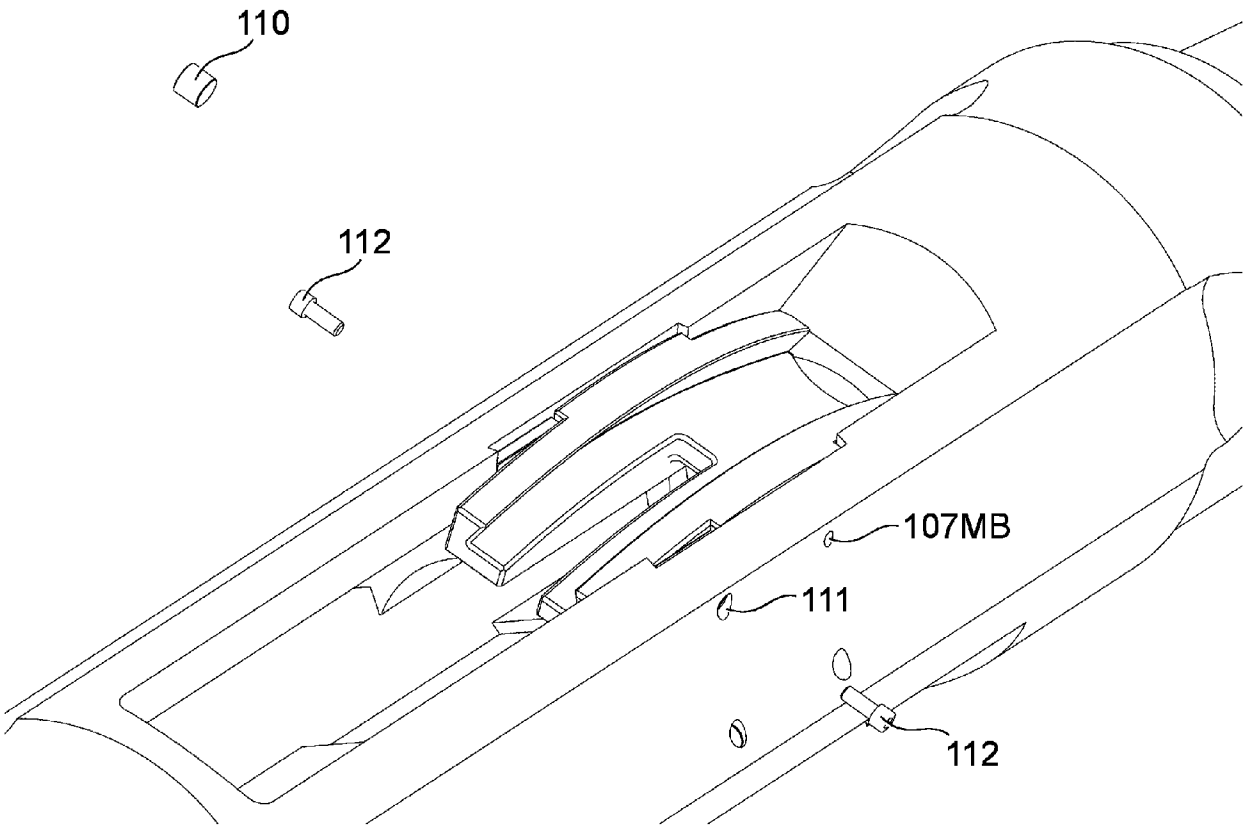
FIG. 13 is an exploded perspective view showing the next stage of installation of the track and cutter blocks (although the cutter blocks are again omitted for clarity) where a dowel rod has been inserted through one side of the tool, through an aperture formed all the way through the track and into the other side of the tool.

The next stage of installation of the track 30 is shown in FIG. 13, where a first end of a dowel rod 108 is passed through a first aperture 107*mb* formed in one side of the main body 10, and passes through an aperture 107*t* which is formed all the way through the track 30 such that the said first end of the dowel rod 108 ends up residing in the other aperture 107*mb* formed on the other side of the main body 10 opposite the said first aperture 107*mb*. A plug 110 is then screwed into each of the apertures 107*mb* such that the dowel 108 is retained in place.

Locking screws 112 are then screwed into apertures 111 which are arranged to be aligned with apertures 113 formed through the locking blocks 106, such that the locking screws 112 retain the locking blocks 106 in place, mounted on the main body 10.

Figure 14:
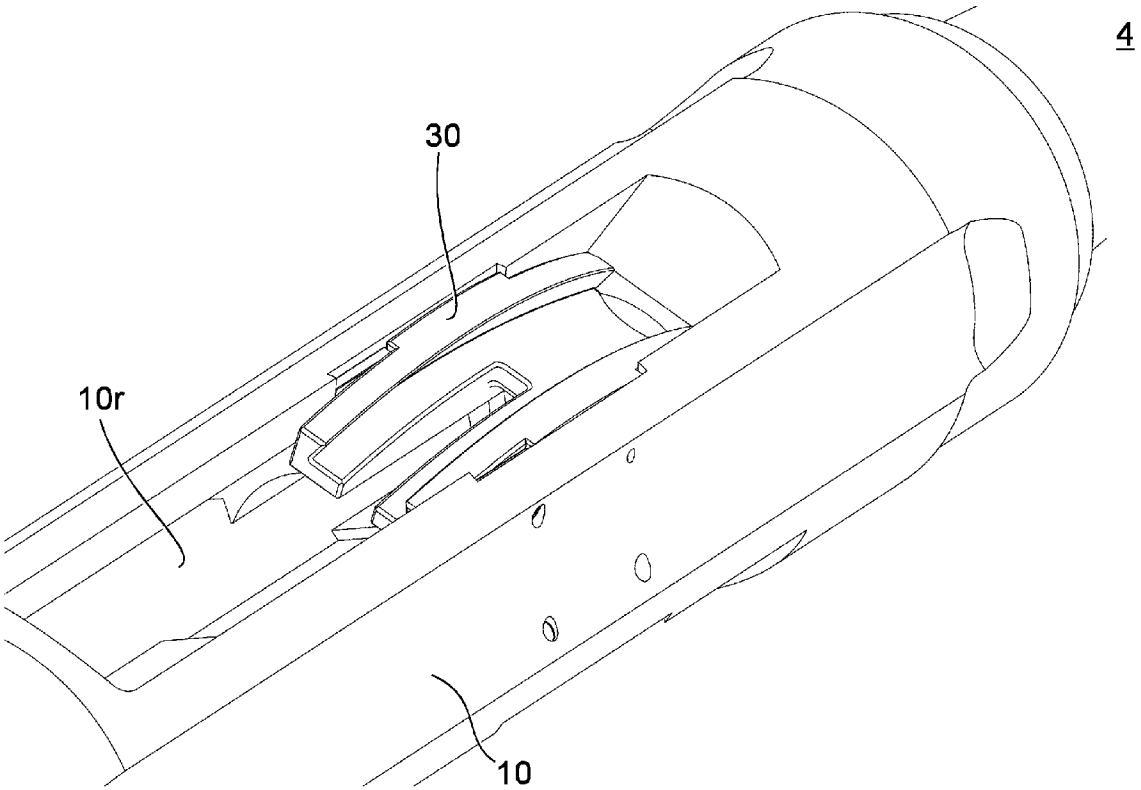
FIG. 14 is a perspective view of the track having been finally and fully installed on the tool after plugs and locking screws have been inserted into position.
Figure 15:
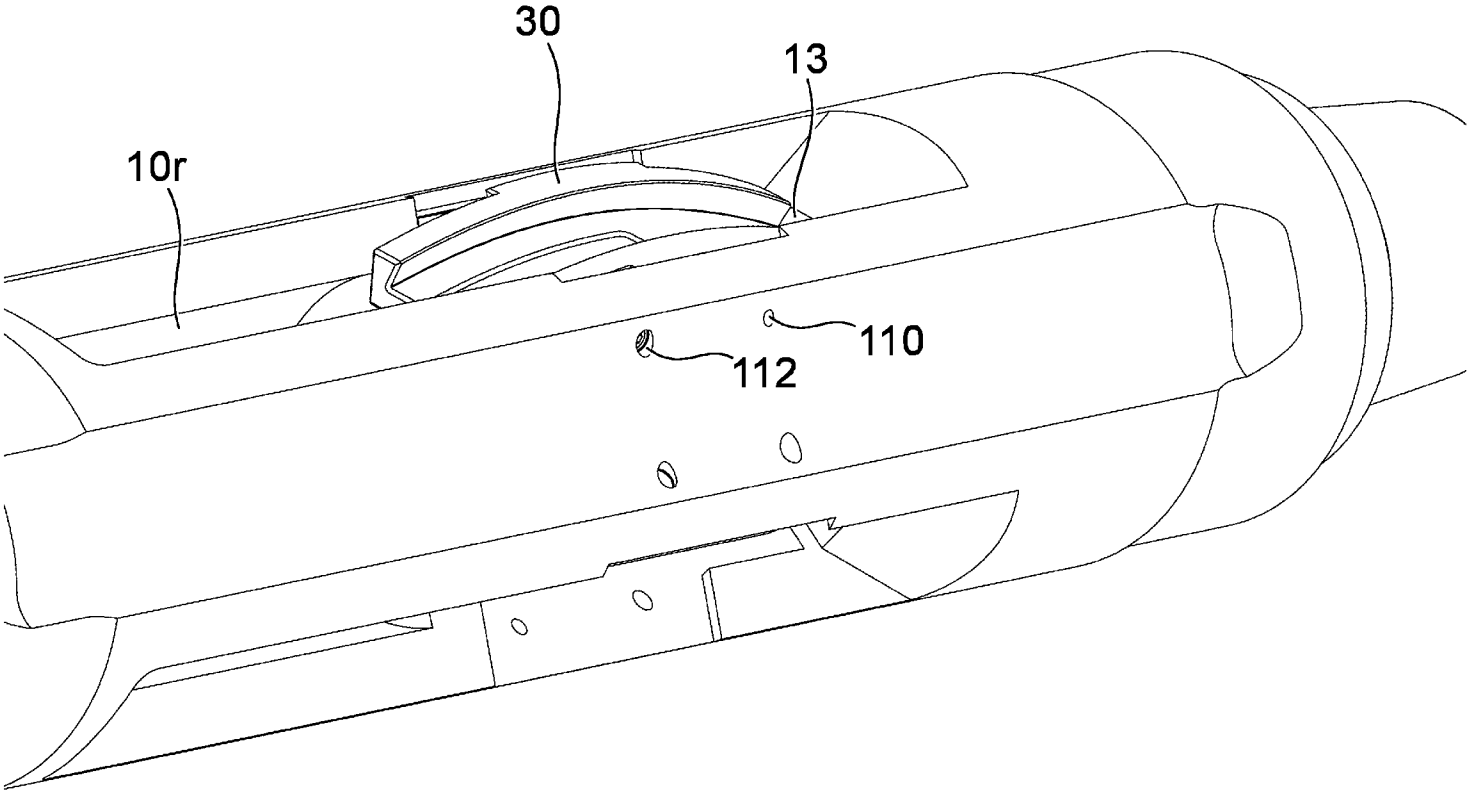
FIG. 15 is a perspective view of the upper portion of the tool of FIG. 14 but from a different angle.

The track 30 (and the omitted cutting block 20) is thus securely held in position, as shown in FIGS. 14 and 15.

This securing mechanism for the track 30 and the omitted cutting block or blade 20 has the advantage that the dowel rod 108 takes only minimal loading and the majority of the loading is taken by the relatively strong main key 102*m* and upper key portion 102U and the respective main slot 100*m* and upper slot portion 100U. Furthermore, the securing mechanism of FIGS. 9-15 has the further advantage that it can be easily and quickly assembled before and/or disassembled after a run in the hole without needing to open up the rest of the tool 1 (particularly the actuation mechanism 50) and this means that a used set of cutting blocks 20 can be easily swapped out for a new set of cutting blocks 20.

The underreamer 1 typically has different modes of operation. In the first mode, the cutter blocks 20 sweep outwards following the curved surface of the track 30 forming an underreamed pocket in the wellbore wall. The cutter blocks 20 rotate into the fully extended position shown in FIG. 4, but the tool 1 does not move along the wellbore. In this first mode, as the cutter block 20 moves from the fully retracted to the fully extended position as shown in FIG. 4, the resultant radial force applied by the cutter block 20 to the rock face of the wellbore wall also increases. This is due to the wedging effect increasing as the cutter block 20 moves closer to the apex or apogee 30*x* of the curved surface of the track 30 in the main body 10 of the tool 1. Thus, as progressively more of the cutting face of the cutter block 20 is exposed to the rock face, the radially applied force necessary to perform the cutting action increases. This provides an efficient, sweeping/scything cutting action which minimises vibration and tool judder.

In a second mode, the underreamer tool 1 moves along the wellbore (whilst rotating) with the tool cutter elements 20 remaining in the fully extended position, thereby underreaming the open hole to the desired size.

In this mode, as the underreamer 1 moves along and further into the wellbore away from the surface, the rock face being cut exerts a force on the cutter block 20 in an upward direction upward toward the end 4 of the tool parallel or close to parallel with the longitudinal axis. As the cutter block 20 is in the fully extended position, close to the apex or apogee 30*x* of the curved surface, this upward force tends to maintain the cutter block 20 in the extended position as shown in FIG. 4, ensuring a full gauge underreamed section is achieved.

In a third mode, the tool 1 is run into or is recovered from the wellbore, and in such a situation, the tool 1 is typically arranged in the retracted configuration shown in FIG. 3.

Actuation of the cutter blocks 20 is selectable, and the mechanism of operation is described now in further detail with further reference to FIGS. 5 to 8.

In these views, further details of the control sleeve 80, the guide ring 70 and the piston 60 can be seen. In particular, the control sleeve 80 has a number of control fingers 82 which extend from the sleeve 80 toward the bottom end 6 of the tool 1 and are circumferentially spaced around the sleeve 80. Between the fingers 82 there are formed v-shaped slots 84 which are arranged to receive an opposing set of fingers 72 of the guide ring 70 and/or ends of circumferentially upstanding ribs 62 formed on the outer surface of the piston 60.

In addition, the control sleeve 80 is formed so that alternate v-shaped slots 84 extend further to form longitudinal extended slots 84*x* (i.e. long stroke slots 84*x*), whilst the intervening slots 84*n* are non-extended (i.e. short stroke slots 84*n*). The extended slots 84*x* are formed to receive upstanding ribs 62 of the piston which can pass under the widened portion of the 80*w* depending upon the configuration/position of the tool 1.

The piston ribs 62 run longitudinally through guide slots (not shown) inside the guide ring 70, and these slots keep the piston 60 in a fixed rotational orientation whilst allowing longitudinal relative movement with respect to the control sleeve 80.

Figure 5:
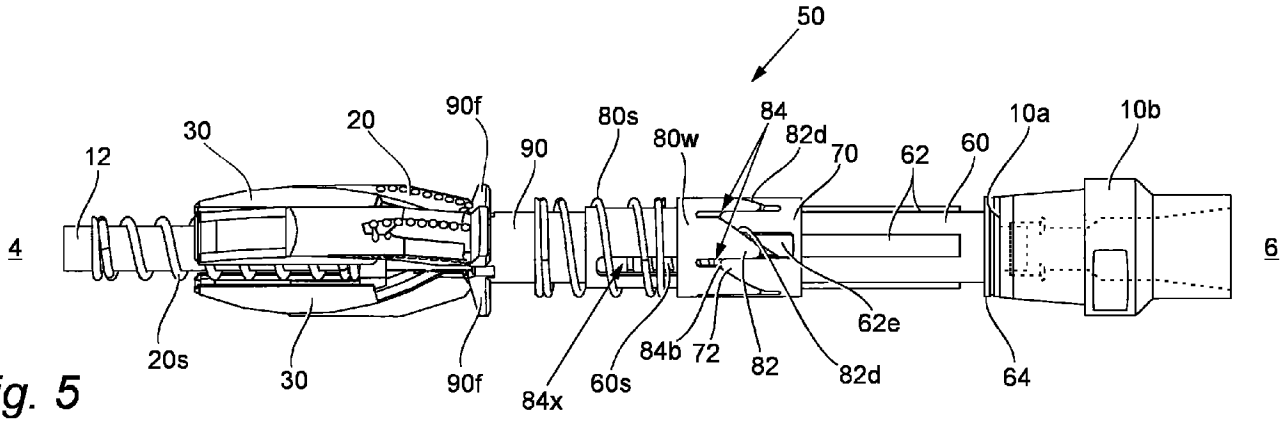
FIGS. 5 to 8 are side view representations of internal components of the downhole tool of FIGS. 1 to 4, showing successive stages of an activation sequence of the tool such that the tool moves from the run-in configuration of FIG. 1 to the activated configuration of FIG. 2.

FIG. 5 shows a first position of the actuation mechanism 50 for actuating the cutters 20. In this initial position, there is no flow through the tubular member 12 and thus no pressure differential to drive the piston 60, and springs 20*s*, 80*s* and 60*s* ensure that the various components are urged toward the lower end 6 of the tool 1, in a similar manner to the configuration of FIG. 3 described above.

In particular, the control sleeve 80 is held in abutment against the guide ring 70 with the guide ring fingers 72 received into the bottom 84*b* of the v-shaped slots 84*n*. Ends 62*e* of the piston ribs 62 sit alongside and in between each of the guide fingers 72 but against a sloped side surface 82*d*, such that further longitudinal movement of the piston ribs 62 (and thus the piston 60) toward the upper end 4 is prevented by the abutment of the ends 62*e* against the sloped side surface 82*d*.

In this configuration typically, the tool 1 is set for running into and use in the well.

Figure 6:
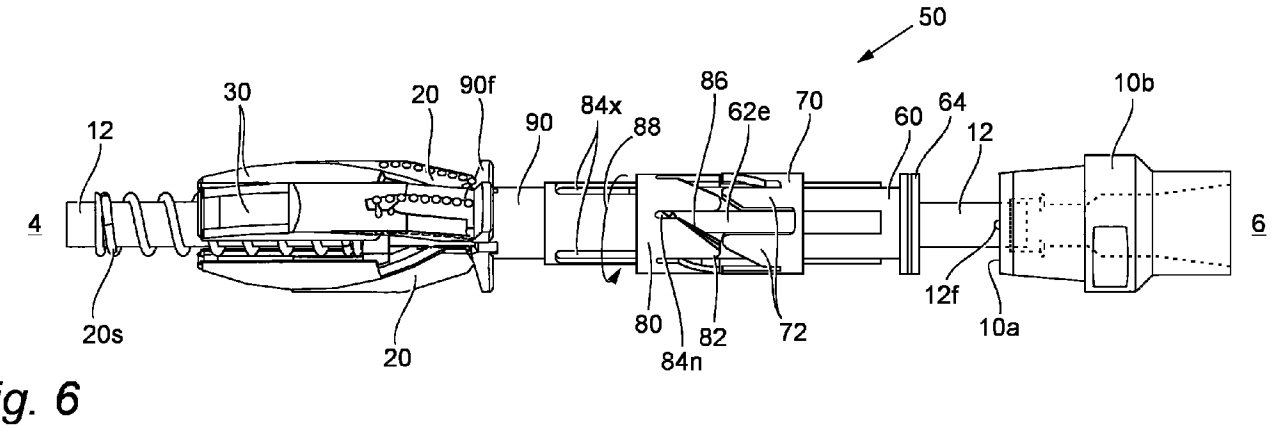

In order to permit a underreaming/drilling operation to be carried out with the tool incorporated in the string, the actuation mechanism 50 is then operated such that it transforms from the first configuration or position of FIG. 5 to a second position as shown in FIG. 6.

In FIG. 6, drill fluid is pumped through the tubular member 12 at full flow to facilitate the drilling operation. This creates a pressure differential across the piston head 64. Accordingly, the piston 60 is moved longitudinally toward the upper end 4 of the tool 1. The piston 60 moves within the guide ring 70 and the ends 62*e* of the ribs 62 engage and bear against the sloped surface 82*d*. Since the piston 60 and guide ring 70 are held rotationally with respect to each other and to the main body 10, the engagement of the piston ribs 62 forces the control sleeve 80 against the spring 80*s* so that the fingers 82 move clear of the opposing set of fingers 72 of the guide ring 70, and the rib ends 62*e* are moved along and up (toward upper end 4) the sloped surface 82*d* which causes the control sleeve 80 to rotate anticlockwise until the ends 62*e* are seated against the bottom 84*b* of the v-shaped slots 84*n* (not connected to the extended slot 84*x*). In this position, the piston 60 is prevented from moving further and prevented from engaging the actuation sleeve 90 and therefore, although full flow is permitted through the tubular string and the central bore or conduit 16 of the tubular main body 10, the cutter blocks 20 are not actuated into the reaming configuration.

Figure 7:
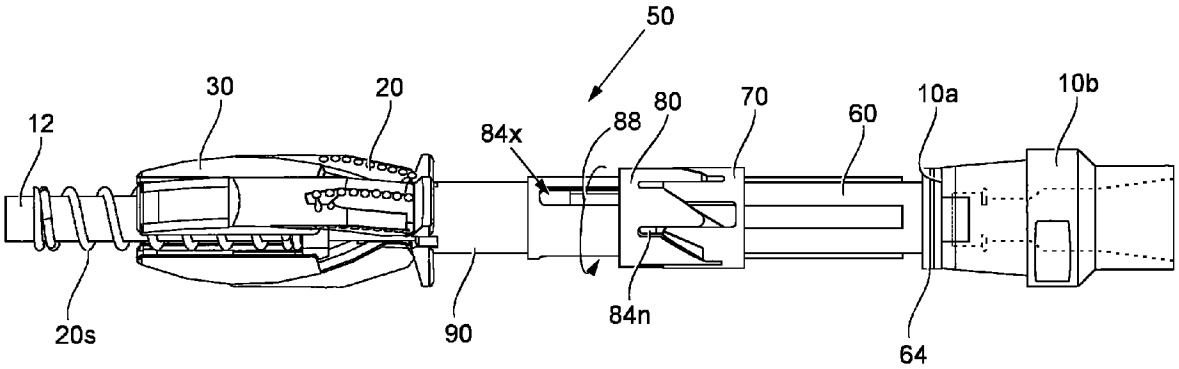

In FIG. 7, the flow is switched off again, the piston 60 returns to the end surface 10*a* and the control sleeve 80 is urged back toward the guide ring 70 by the biasing springs (not shown). Typically, this is done at the end of a drilling operation. As this takes place, guide fingers 72 slot into the bottom of the v-shaped slots 84 as the ends of the piston ribs 62 move away, moving along the inclined surface 82*d*, and once again causing the control sleeve 80 to rotate anticlockwise according to arrow 88 until the fingers 62 are seated in the position of FIG. 7.

In this position, the ribs 62 and the guide fingers 72 are located in the v-shaped slot in a similar manner to that described in relation to FIG. 5, but in this case, the ribs 62 and fingers 72 are located in the alternate v-slot aligned with extended longitudinal slot 84*x*. The guide finger 72 is an intended misfit with the extended longitudinal slot 84*x* to thereby keep the control sleeve 80 in the FIG. 7 position.

Figure 8:
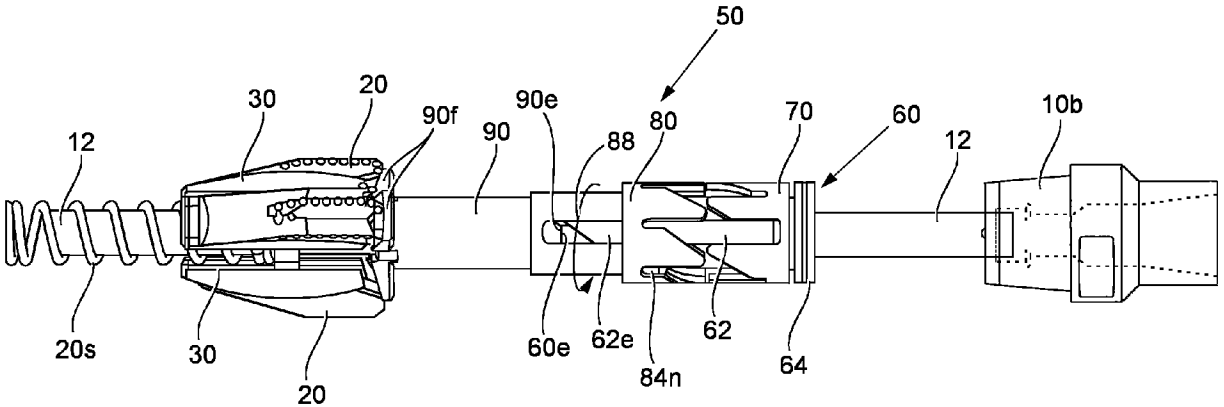
Figure 9:
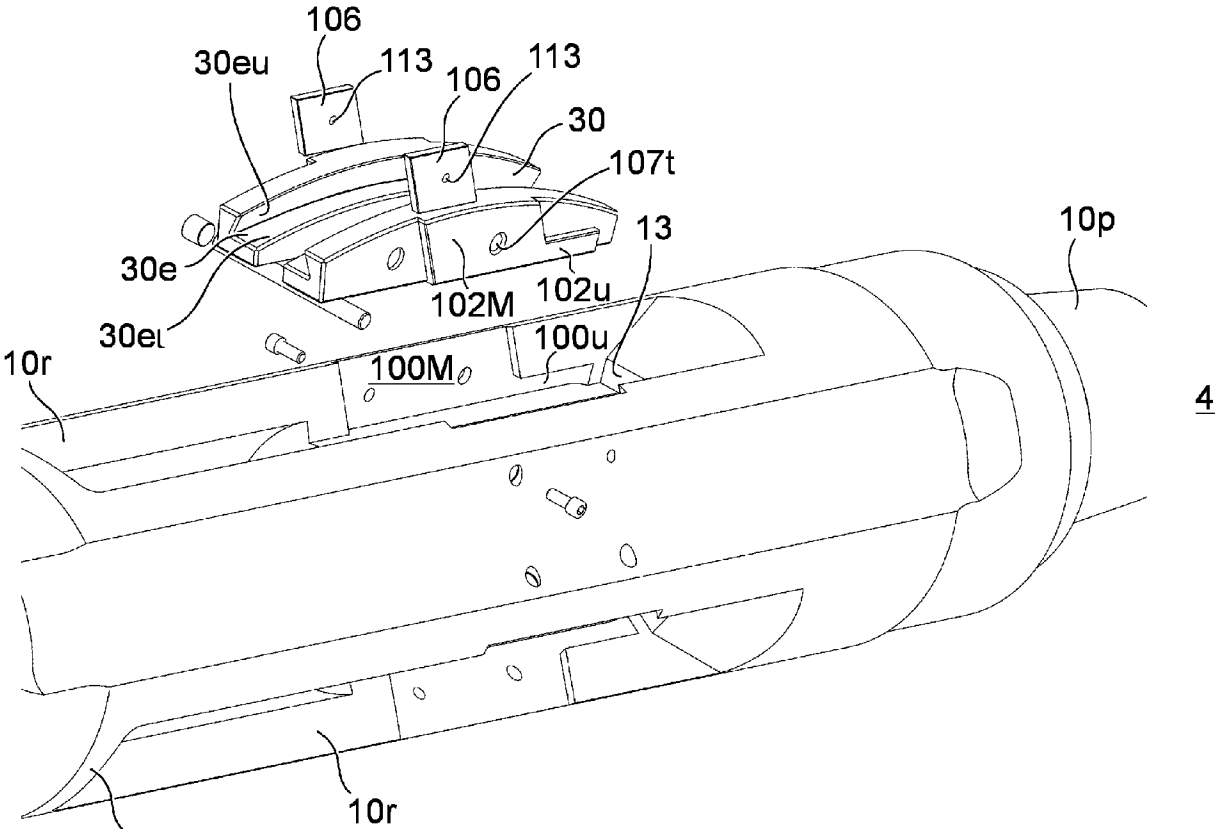
FIG. 9 is an exploded perspective view of the upper most part of the tool (but with the cutter blocks removed for clarity) particularly showing the curved track and the components used to retain the curve track on the tool.
Figure 10:
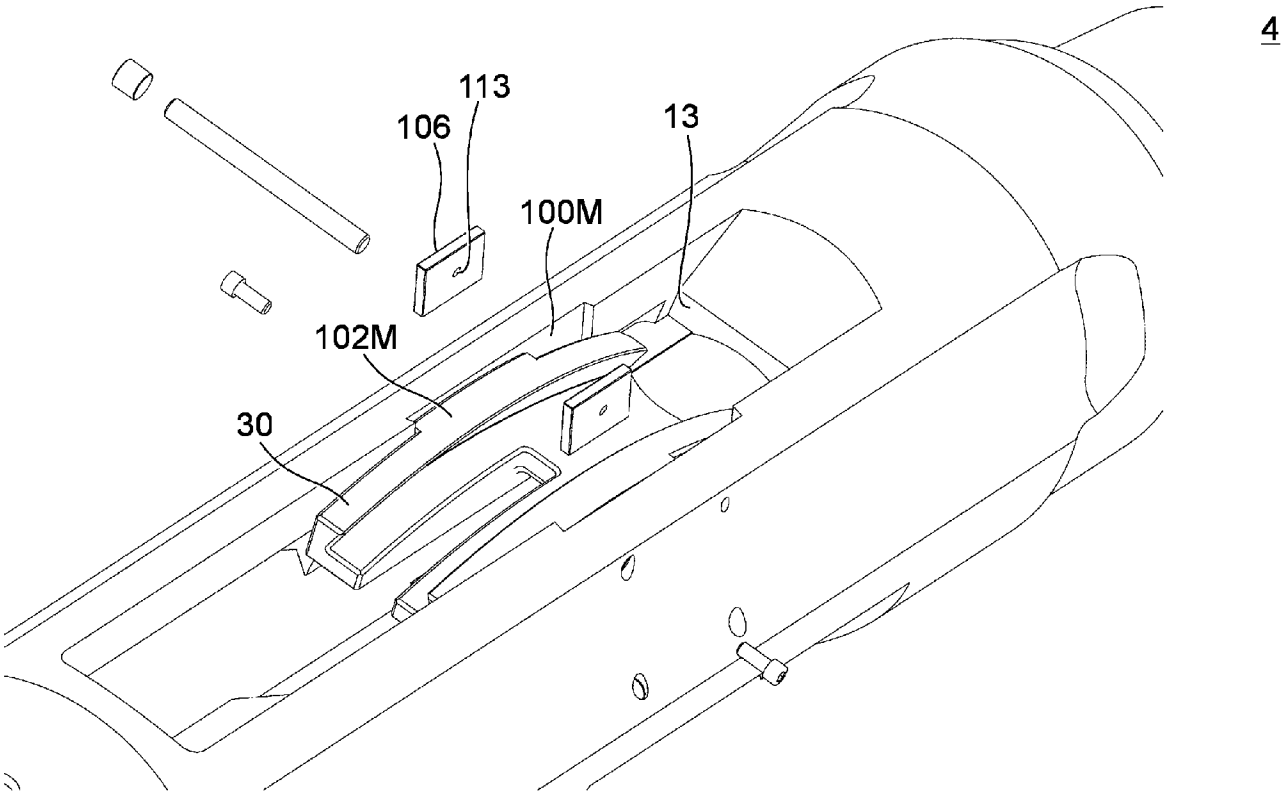
FIG. 10 is an exploded perspective view of the upper portion of the tool (viewed from a different angle to that shown in FIG. 9) showing a first stage of installation of the track on the tool, but with the cutter blocks again omitted for clarity, where the track is being inserted into a recess in the tool.

When required, flow through the tubular string is recommenced to start a reaming operation, and the tool 1 then moved from the FIG. 7 position to the position of FIG. 8. As described before in relation to FIG. 6, the piston 60 is moved longitudinally, and piston ribs 62 engage with the v-shaped slot 84 to move the control sleeve 80 rotationally. However in this case, it is moved so that the ribs 62 of the piston 60 align with the extended slot 84*x*, and move underneath the bottom 84*b* of the v-shaped slot 84, and fully into the extended slot 84*x*. This allows the piston end 60*e* to engage an end 90*e* of the actuation sleeve 90 in this case, and to thereby drive the actuation sleeve 90 against cutter blocks 20 and move them along the arc track 30 into the actuated position for reaming, as shown and described above in relation to FIG. 4.

By virtue of spring 80*s* acting against the control sleeve 80 and in turn piston 60, the control sleeve 80 is prevented from indexing to the next slot position until sufficient force is applied by the piston 60 (driven by differential pressure) against the spring 80*s*. Thus, by way of the biasing springs, the tool 1 is set up so that the control mechanism 50 will not move the control sleeve 80 to the next position, for example to actuate the cutter blocks 20, without the required amount of differential pressure (across the piston head 64) or circulation rate (of fluid pumped through the tool 1 and tubular string) being applied. Typically, the tool 1 is set up so that it will not index from one position to another unless a cycle of pump "off" to pump "on" is applied at a specific, predetermined pump rate, as may be desired to effect proper combined drilling and underreaming operations. This option prevents the tool 1 being accidentally activated at lower fluid circulation rates.

The threshold pressure or flow rate, above which the control sleeve 80 can index to the next slot position and actuate the cutter blocks 20 to be moved into their extended positions, is set by the biasing springs, primarily the spring 80*s*. Thus, the tension of the biasing springs may be adjusted or rated according to the desired threshold pressure or flow rate needed to overcome the biasing force imparted by the springs. In practice, the spring 80*s* have a high rating so that for example a flow rate of 1200 gallons/min or above is required to activate the tool 1.

In many instances, the underreamer 1 will be included in a tubular string with other tools attached, where it will be desirable to circulate fluid through the string, without causing the control sleeve 80 to index to the next position. The present configuration allows this to be achieved as fluids circulated at rates below the threshold do not index the sleeve 80 and therefore the cutter blocks 20 are not moved to the extended position; the sleeve 80 is only indexed when the threshold rate or pressure of the tubular fluid for overcoming the spring bias is exceeded. This allows other operations, such as a wellbore clean-up operation, to be performed whilst the underreamer 1 is incorporated in the sting. A high spring rating on the underreamer 1 provides for a wide range of circulation rates to be used for other operations without causing the underreamer cutters 20 to engage or causing the control sleeve 80 to index.

When the reaming operation is finished, the flow can again be switched off and the blades 20 and actuation mechanism 50 will return to its original position of FIG. 5 by way of the biasing springs.

The present invention provides a number of advantages. In particular, the arcuate motion of the tool elements 20 presents the tool element 20 to the wellbore wall in a gradual fashion and at a shallow initial angle relative to the wall which provides an enhanced wedge effect to facilitate engagement of the tool elements 20 with the wellbore. In addition, with the tool element 20 in the fully extended position, the shallow angle formed between the tool element 20 and the wellbore wall provides helps maintaining the tool element 20 in the fully extended position during an underreaming operation when the tool 1, with the tool element 20 fully extended, travels along the wellbore. In addition, actuation of the tool elements 20 can be readily controlled by merely switching on and/or switching off flow through the conduit 16, independently of well pressure conditions. In addition, low force requirements for holding the tool elements 20 in the fully extended positions in reaming operation is facilitated due to their mounting on an arc interface by means of the arced track 30.

Various modifications and improvements can be made within the scope of the invention.

For example, the track 30 and the orientation of the same could be modified from the arrangement described above that extends parallel to the longitudinal axis 18 such that it could:— a) curve around the tool 1 in a partial helix; or b) be offset from the radial axis such that the cutter blade 30 extends outwardly from the tool but not in a radial manner; or c) the track could be angled with respect to the longitudinal axis 18 such that it does not extend parallel with respect to the longitudinal axis 18 but extends at an angle thereto.

Furthermore, a selective locking mechanism could be provided by for example, a shear pin (not shown) or a sprung loaded detect mechanism that acts between the piston 60 and the inner tubular member 12 such that the tool 1 will not operate at all until very high pressure is applied that is sufficiently high to overcome or destroy the selective locking mechanism.

We claim:

1. An underreamer tool for use in a wellbore the tool comprising: a body having a longitudinal axis, a tool element and an actuation device configured to urge the tool element relative to the body from a first configuration into a second configuration, wherein a portion of the tool has a curved actuation surface and wherein the tool element is urged across the curved actuation surface of the tool whereby movement of the tool element across the curved actuation surface moves the tool element radially with respect to the body of the tool;

wherein the actuation device is hydraulically responsive or pressure responsive;

wherein the curved actuation surface comprises an arcuate track and the tool element is mounted on the track so as to permit axial translation and radial movement of the tool with respect to the longitudinal axis of the body; and wherein the track is coupled to the body by a securing mechanism comprising a key provided on one of the track and the body and a slot provided on the other of the track and the body, wherein the slot is larger than the key to thereby provide a gap into which a locking block can be inserted to selectively lock the securing mechanism.

2. An underreamer tool as claimed in claim 1, wherein the curved actuation surface is in the form of an arc.

3. An underreamer tool as claimed in claim 2, wherein the arc extends radially with respect to the longitudinal axis of the tool and comprises a constant radius along its length.

4. An underreamer tool as claimed in claim 2, wherein the arc has a circumference aligned longitudinally with respect to the longitudinal axis of the tool and wherein the arc is arranged with two opposite ends closest to the longitudinal axis of the tool and with an apogee of the arc with respect to the longitudinal axis of the tool arranged in between the said two ends.

5. An underreamer tool as claimed in claim 1, wherein the track comprises a retention mechanism to restrict lateral movement of the tool element with respect to the longitudinal axis, the retention mechanism comprising track portions for engagement with the tool element.

6. An underreamer tool as claimed in claim 1, wherein the securing mechanism can be selectively enabled and disabled from outside the tool without the requirement to disassemble the actuation mechanism of the tool.

7. An underreamer tool as claimed in claim 1, wherein the tool is provided with a plurality of circumferentially spaced tool elements each mounted to a track for longitudinal translation of the tool elements along respective tracks.

8. An underreamer tool as claimed in claim 1, wherein the tool element has an outer surface for engaging a wellbore wall and an inner surface for engaging said curved actuation surface of the tool.

9. An underreamer tool as claimed in claim 8, wherein the outer surface of the tool element is provided with cutting elements for cutting into a wellbore wall.

10. An underreamer tool as claimed in claim 9, wherein the outer surface of the tool element extends between first and second ends of the tool element, and is provided with a first group of cutting elements toward the first end and a second group of cutting elements toward the second end of the tool element.

11. An underreamer tool as claimed in claim 8, wherein the outer and inner surfaces of the tool element respectively define first and second substantially arcuate surfaces.

12. An underreamer tool as claimed in claim 11, wherein the first and second substantially arcuate surfaces have different radii of curvature.

13. An underreamer tool as claimed in claim 1, wherein the tool element has first and second ends having different thicknesses.

14. An underreamer tool as claimed in claim 13, wherein the first end is thinner than the second end, the first end arranged to lead the second end during movement of the tool element across the curved actuation surface into the second configuration for engagement with the wellbore.

15. An underreamer tool as claimed in claim 1, wherein at least a portion of the tool element is in the form of a wedge configured to wedge between the main body of the tool and a wall of the wellbore, in use when the tool element is in the second configuration.

16. An underreamer tool as claimed in claim 13, wherein when the tool element is in the second configuration, the second end of the tool element is more radially displaced than the first end of the tool element with respect to the longitudinal axis of the tool.

17. An underreamer tool as claimed in claim 12, wherein a second end of the tool element is configured to engage the wellbore wall after a first end has engaged the wellbore wall, during translation of the tool element across said curved actuation surface from the first configuration to the second configuration.

18. An underreamer tool as claimed in claim 1, wherein in the first configuration, the tool element is retracted and in the second configuration, the tool element is more radially extended, with respect to the longitudinal axis of the tool, and wherein in the second configuration, an apogee of the outer surface of the tool element with respect to the longitudinal axis of the tool is substantially aligned with an apogee of the curved actuation surface of the tool with respect to the longitudinal axis of the tool.

19. A method of actuating an underreamer tool in a wellbore, the underreamer tool comprising: a body having a longitudinal axis, a tool element and an actuation device configured to urge the tool element relative to the body from a first configuration into a second configuration, wherein a portion of the tool has a curved actuation surface, wherein the curved actuation surface comprises an arcuate track and the tool element is mounted on the track so as to permit axial translation and radial movement of the tool with respect to the longitudinal axis of the body, wherein the actuation device is hydraulically responsive or pressure responsive; and wherein the track is coupled to the body by a securing mechanism comprising a key provided on one of the track and the body and a slot provided on the other of the track and the body, wherein the slot is larger than the key to thereby provide a gap into which a locking block can be inserted to selectively lock the securing mechanism, the method comprising the steps of: urging the tool element across the curved actuation surface of the tool, whereby the tool element simultaneously moves radially with respect to the main body of the tool.

* * * * *

UNITED STATES PATENT AND TRADEMARK OFFICE

CERTIFICATE OF CORRECTION

PATENT NO. : 8,905,158 B2
APPLICATION NO. : 13/201117
DATED : December 9, 2014
INVENTOR(S) : Darren Ritchie It is certified that error appears in the above-identified patent and that said Letters Patent is hereby corrected as shown below:

In the Claims

Claim 6, Col. 20, line 47, please replace “mechanism” with --device--

Signed and Sealed this
Sixteenth Day of June, 2015

Michelle K. Lee

Michelle K. Lee
*Director of the United States Patent and Trademark Office*